US006058854A

United States Patent [19]

Tarnay et al.

[11] Patent Number: 6,058,854

[45] **Date of Patent: *May 9, 2000**

[54] LIGHTWEIGHT PLASTIC FURNITURE

[75] Inventors: Matt Tarnay; Clifford Raab, both of Torrance, Calif.

[73] Assignee: Virco Mfg. Corporation, Torrance, Calif.

[ * ] Notice: This patent is subject to a terminal disclaimer.

[21] Appl. No.: 08/937,014

[22] Filed: Sep. 24, 1997

Related U.S. Application Data

[63] Continuation-in-part of application No. 08/592,458, Jan. 26, 1996, Pat. No. 5,694,865, which is a continuation-in-part of application No. 08/547,658, Oct. 24, 1995, Pat. No. 5,732,637.

[51] Int. Cl.[7] ..... A47B 13/00

[52] U.S. Cl. ..... 108/161; 108/901

[58] Field of Search ..... 108/161, 901, 108/129, 131, 50.02; 248/188.8

[56] References Cited

U.S. PATENT DOCUMENTS

| | | | |
|---|---|---|---|
| 4,951,576 | 8/1990 | Cobos et al. | 108/131 |
| 5,271,338 | 12/1993 | Bonham | 108/161 |
| 5,443,020 | 8/1995 | Price | 108/901 |
| 5,694,865 | 12/1997 | Raab | 108/161 |
| 5,732,637 | 3/1998 | Raab | 108/129 |

*Primary Examiner*—Peter M. Cuomo
*Assistant Examiner*—Gerald A. Anderson
*Attorney, Agent, or Firm*—James E. Brunton, Esq.

[57] ABSTRACT

A lightweight, high-strength support platform for use in furniture construction, which has superior structural integrity and can be used, by way of example, in portable folding tables, in work tables and in modular furniture of the character typically used in modern office complexes. The support platform embodies a novel structural reinforcement core, and exhibits superior strength characteristics. In one form of the invention, the support platform is used in the construction of a lightweight, readily portable folding table which includes two pair of legs that are pivotally connected to the platform for pivotal movement between an extended operational position and a retracted storage and transport position.

6 Claims, 7 Drawing Sheets

FIG. 1
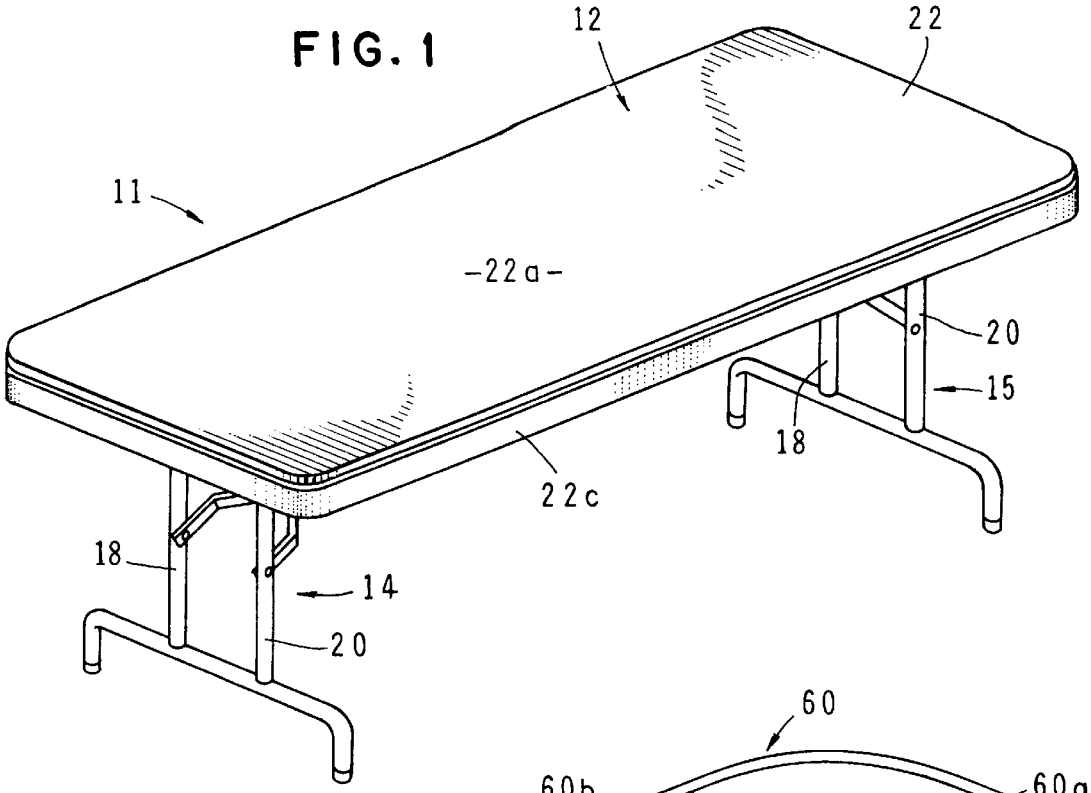
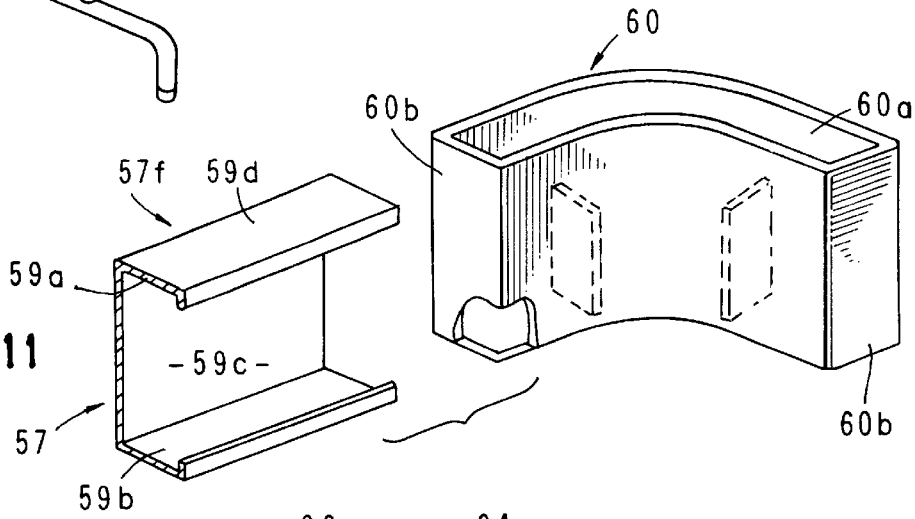
FIG. 11
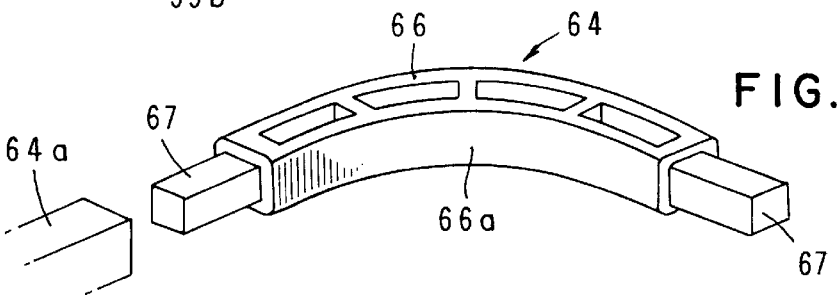
FIG. 12

22
22a
11
22c
22b
24
34
40
28
30
37
34b
40
30
40a
40b
60
57b
57a
57
60
60
57
57a
57b
60

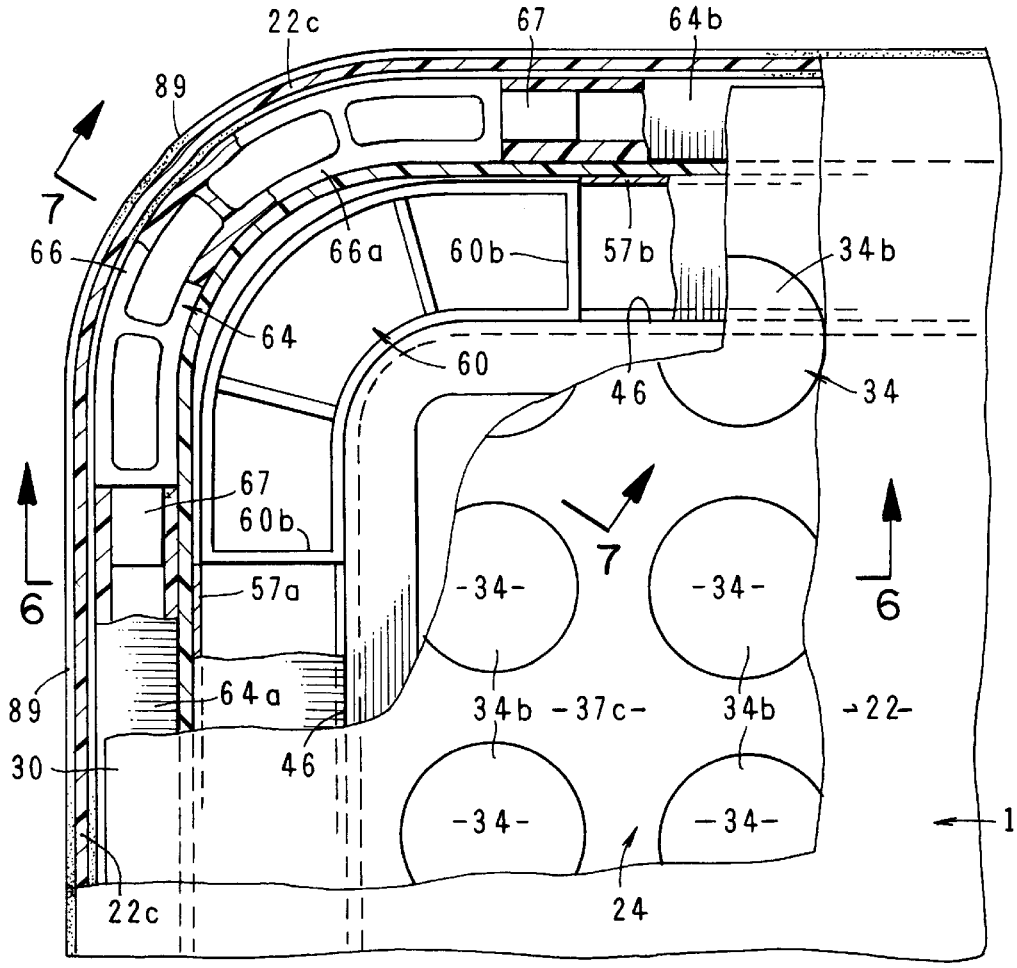
FIG. 5
FIG. 6
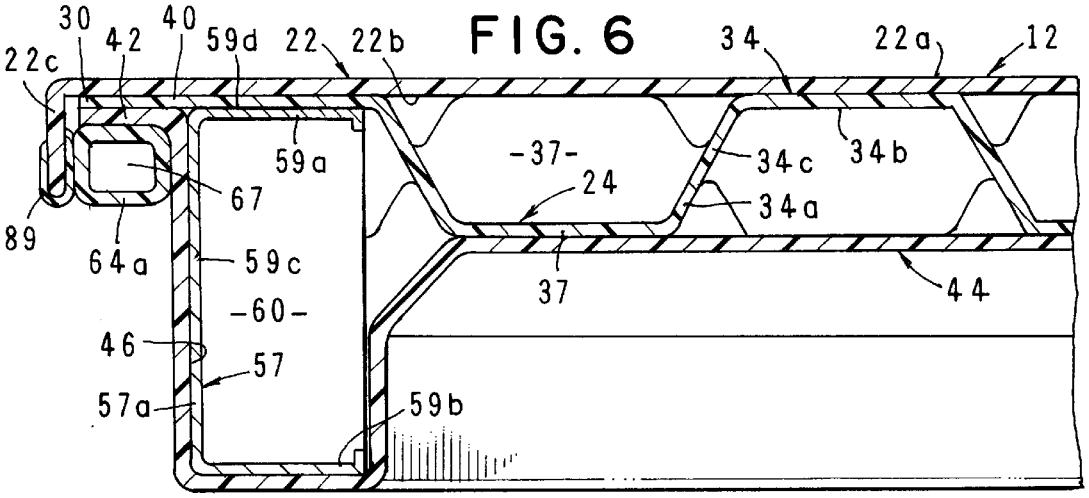

LIGHTWEIGHT PLASTIC FURNITURE

This is a Continuation-In-Part application of application Ser. No. 08/592,458 filed Jan. 26, 1996 now U.S. Pat. No. 5,694,865 which is a Continuation-In-Part of application, Ser. No. 08/547,658 filed Oct. 24, 1995 now U.S. Pat. No 5,732,637.

BACKGROUND OF THE INVENTION

Field of the Invention

The present invention relates generally to plastic furniture. More particularly, the invention concerns a lightweight plastic folding table having a novel, structurally reinforced support platform providing a work surface.

DISCUSSION OF THE INVENTION

Lightweight furniture which exhibits superior structural characteristics is in wide demand for many industrial and institutional applications. Entities having great need for such furniture include schools, convention centers, hotels, factories, business offices and various governmental entities. Particularly in demand are lightweight folding tables and lightweight modular units for use in offices and the like which are readily portable and easily storable when not in use.

While many types of lightweight furniture have been suggested in the past, a typical drawback of such furniture is a lack of structural integrity which tends to contribute to limited useful life and to frequent structural failures. As a general rule, when the prior art furniture designers have attempted to correct the structural deficiencies in the prior art designs, the furniture becomes excessively heavy and unduly bulky. As will be discussed in greater detail in the paragraphs that follow, the thrust of the present invention is to provide lightweight, readily portable furniture which embodies a unique structural reinforcement core that provide superior structural integrity to the furniture without unduly increasing its weight or bulkiness.

Exemplary of typical prior art plastic folding tables are those described in U.S. Pat. No. 4,951,576 issued to Cobos et al. The Cobos et al tables include upper and lower plastic table top halves and a framework grid, preferably made of wood, sandwiched therebetween. Another example of a prior art folding table is that described in U.S. Pat. No. 5,394,808 issued to Dutro et al. This table has a unitary table top formed of molded plastic preferably having an outer shell of non-cellular plastic with a filling of lightweight hardened foam. Other examples of prior art table constructions can be found in U.S. Pat. No. 5,271,338 issued to Bonham and in U.S. Pat. No. 3,628,470 issued to DeLucas. French Patent No. 1371706 issued to Evans shows a reinforcement member having a multiplicity of upstanding protuberances. However, the balance of the Evans structure is totally dissimilar to that of the present invention.

Because of the general similarities between the table of the present application and the table described in U.S. Ser. No. 08/592,458, of which this application is a Continuation-In-Part, application Ser. No. 08/592,458 filed by one of the present inventors on Jan. 26, 1996 is hereby incorporated by reference as though fully set forth herein.

SUMMARY OF THE INVENTION

It is an object of the present invention to provide a lightweight, high-strength support platform for use in furniture construction, which has superior structural integrity and can be used, by way of example, in portable folding tables, in work tables and in modular furniture of the character typically used in modern office complexes.

More particularly, it is an object of the invention to provide a lightweight support platform of the aforementioned character which embodies a novel structural reinforcement core which is both lightweight and exhibits superior strength and durability characteristics.

Another object of the invention is to provide a lightweight, readily portable folding table which embodies a lightweight plastic support platform of the character described in the preceding paragraphs and which the table includes structural reinforcement beams (which are generally "C" shaped in cross section) and further includes pivotally mounted legs that can be pivoted from an extended operational position into a retracted storage and transport position wherein they abut the reinforcement core of the support platform.

Another object of the invention is to provide a lightweight folding table which includes a uniquely configured top, the margins of which are reinforced by a novel structural reinforcement frame.

Another object of the invention is to provide a lightweight folding table of the aforementioned character which is unusually strong, is highly reliable in use and has a long useful life.

Another object of the invention is to provide a lightweight, high-strength foldable table of the character described which is constructed from readily available moldable plastic materials and one which can be efficiently and inexpensively manufactured in high volume.

Still another object of the invention is to provide a light weight folding table of the class described in the preceding paragraphs which is highly attractive and easy to operate.

BRIEF DESCRIPTION OF THE DRAWINGS

FIG. 1 is a generally perspective view of one embodiment of the lightweight plastic furniture of the present invention shown there as a lightweight folding table.

FIG. 5 is an enlarged, top plan view of one corner of the folding table of the invention partly broken away to show internal construction.

FIG. 6 is an enlarged, cross-sectional view taken along lines 6—6 of FIG. 5.

FIG. 11 is a fragmentary, generally perspective view of a portion of one of the structural beams and of a corner member of the reinforcement frame of the invention.

FIG. 12 is a fragmentary, generally perspective view of a portion of one of the tubular members and one of the corners of the edge reinforcing frame of the invention.

DESCRIPTION OF THE INVENTION

Figure 2A:
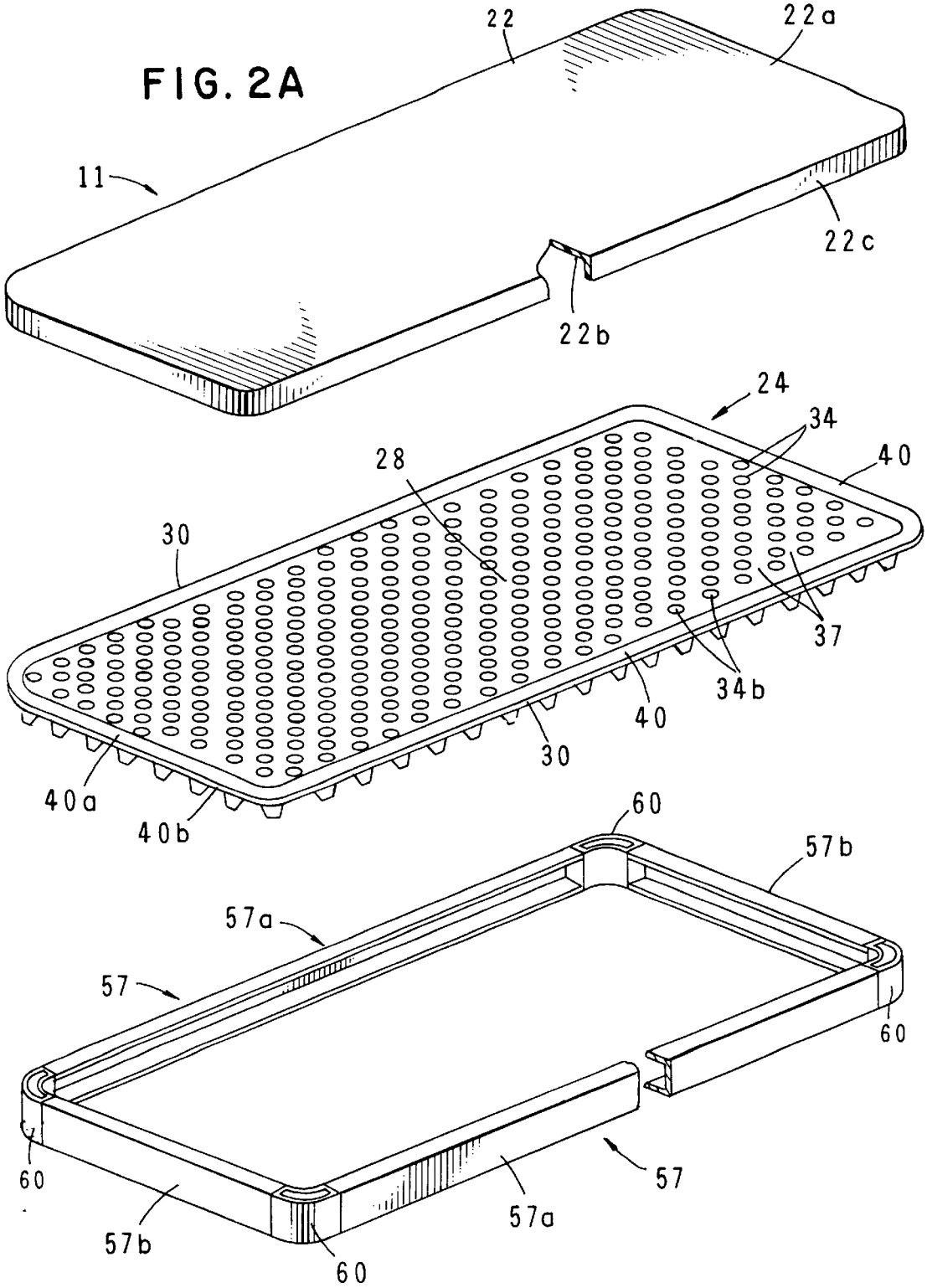
FIGS. 2A and 2B together comprise a generally perspective, exploded view of the folding table construction shown in FIG. 1.
Figure 2B:
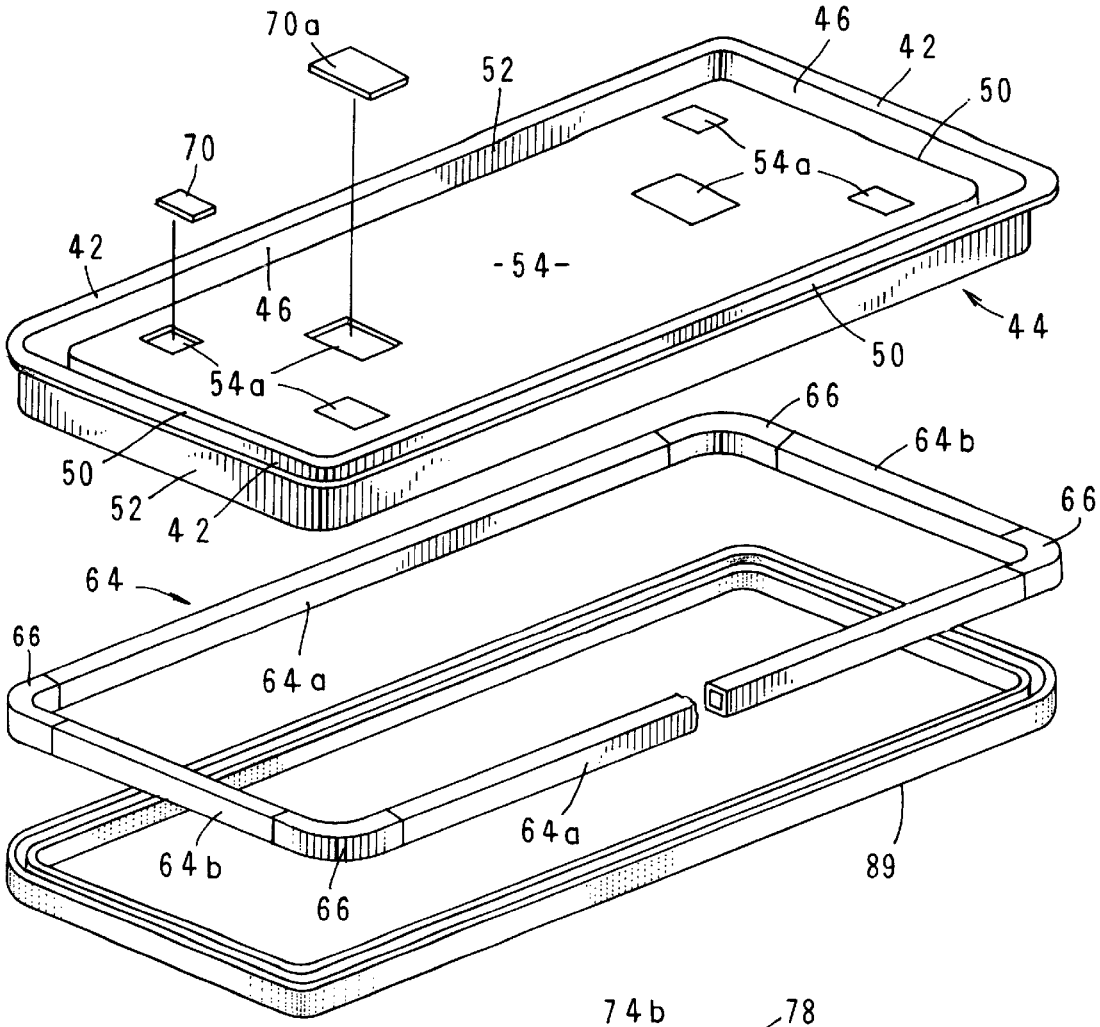
Figure 2B:
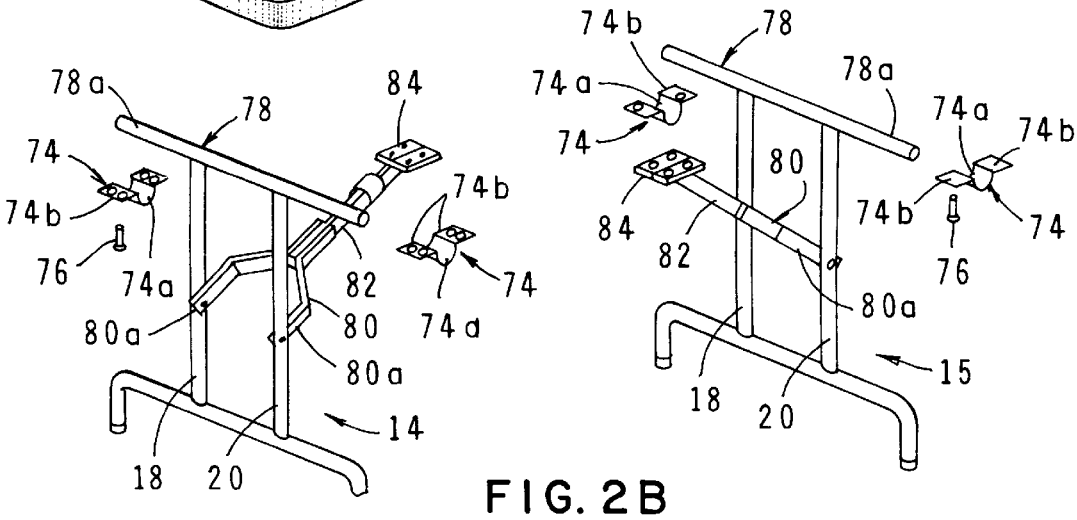

Referring to the drawings and particularly to FIGS. 1, 2A and 2B, one embodiment of the lightweight, high strength folding table of the present invention is there illustrated and generally designated by the numeral 11. The folding table of this form of the invention is similar in many respects to the folding tables shown in incorporated by reference Ser. No. 08/592,458 and comprises a support platform assembly 12 and first and second leg assemblies 14 and 15, each of which comprises a pair of downwardly extending legs designated in FIG. 1 as 18 and 20, which legs are pivotally connected to platform 12.

An important feature of the present invention is the uniquely configured support platform 12 which is used in the construction of table 11. Referring particularly to FIGS. 2A and 2B, this novel support platform can be seen to comprise a support member or cover 22 which defines a work surface 22*a* and a structural reinforcement panel 24 (FIG. 2B) which is connected to support member 22 in a manner presently to be described.

Figure 3:
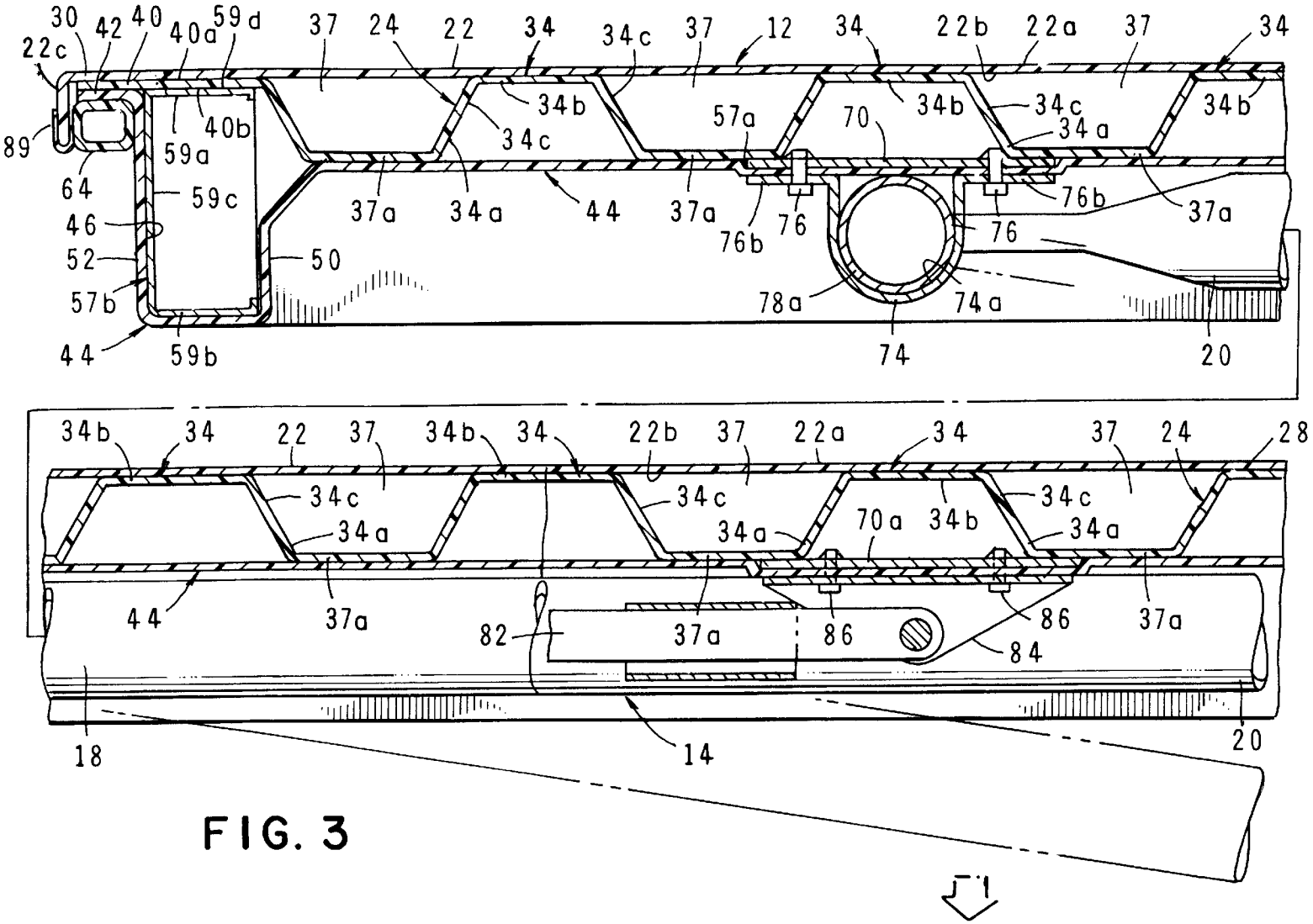
FIG. 3 is an enlarged, longitudinal, cross-sectional view of the left-hand portion of the folding table shown with the legs folded in a stowed configuration.

As best seen in FIGS. 2A and 3, support member 22 includes a generally planar first or work surface 22*a* as well as a second generally planar surface 22*b* which is spaced apart from surface 22*a*. Additionally, support member 22 includes a peripheral side wall 22*c* which circumscribes first surface 22*a* and defines a downwardly depending, skirt-like portion of the character best seen in FIG. 2A. Support member 22 can be constructed from a number of different types of moldable plastic materials such as polyethylene, styrene, polyproplylene and like materials. However, acrylonitrile butadiene styrene (ABS) is preferred.

Figure 4:
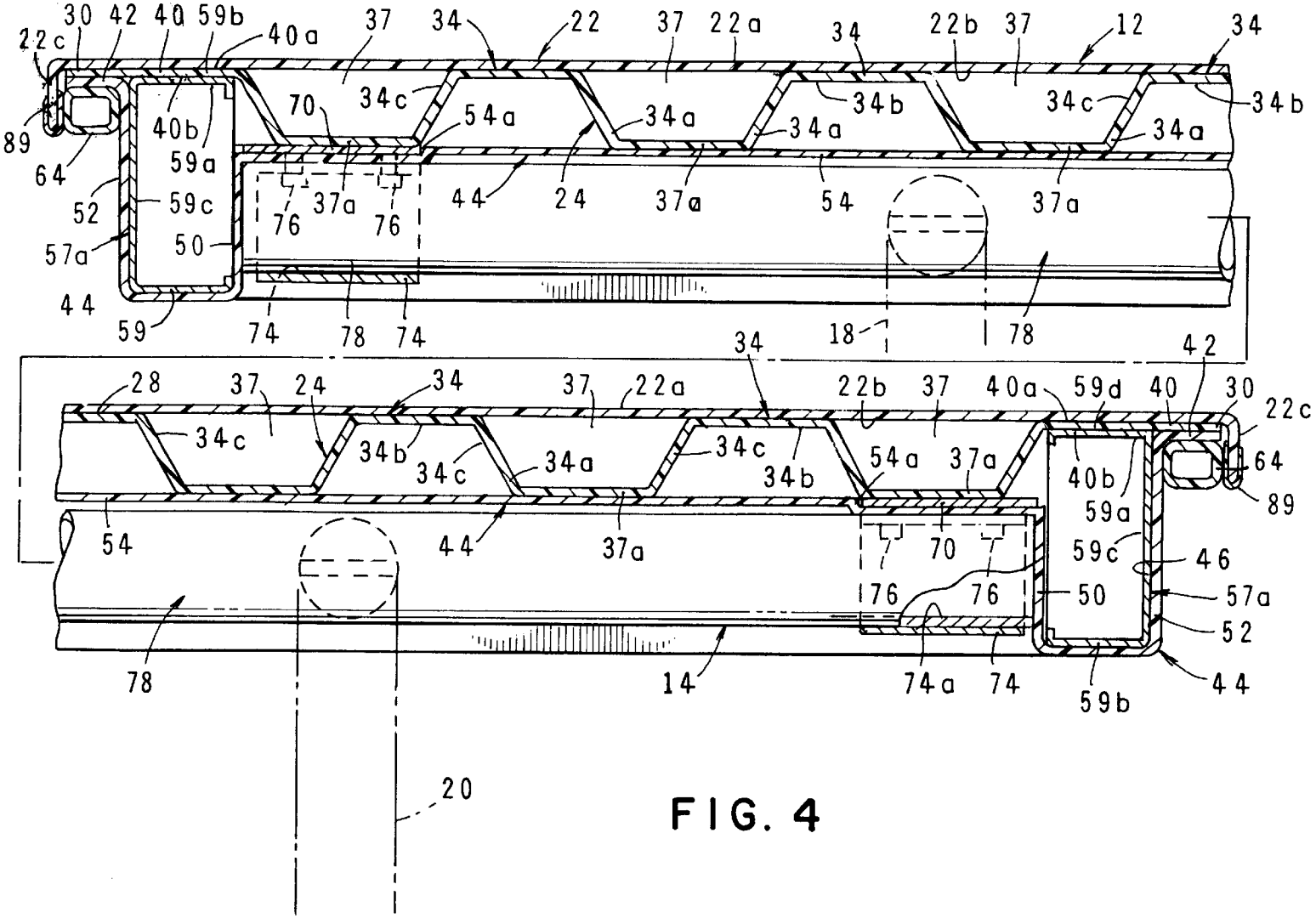
FIG. 4 is an enlarged, transverse, cross-sectional view of the folding table shown with the legs folded into a stowed configuration.

An important aspect of the support platform construction of the present invention is the uniquely configured, relatively thin plastic reinforcement panel 24. As illustrated in FIGS. 4 and 5 reinforcement panel 24 is interconnected with support member 22 and functions in a novel manner to provide substantial structural support to member 22 so that work surface 22*a* can withstand substantial vertical loading. Panel 24 can be of various configurations and can also be constructed from a number of moldable plastic materials of the character described in the preceding paragraph, but once again ABS is preferred. Depending upon the material selected, panel 24 can be vacuum formed, injection molded or molded in a number of other ways well known to those skilled in the art.

Referring particularly to FIGS. 2A, 3 and 4, the novel reinforcement panel 24 can be seen to include a central portion 28 and a peripheral portion 30 which circumscribes central portion 28. The central portion is uniquely formed to provide a multiplicity of spaced-apart, specially configured upstanding protuberances 34. As shown in FIGS. 3 and 4, each protuberance 34 comprises a base portion 34*a*, a vertically spaced-apart, generally circular-shaped closure wall 34*b*, and a tapered connecting wall 34*c* which interconnects base portion 34*a* and closure wall 34*b*. While protuberances 34 are shown in the drawings as being generally frustoconical in shape, the protuberances can take on a wide variety of shapes. For example, top wall 34*b* of each protuberance, rather than being circular in shape, could be hexagonal or octagonal in shape should the designer so desire. As was the case in the table described in incorporated by reference application, Ser. No. 08/592,458 (FIG. 9), a multiplicity of web-like structures interconnect protuberances 34 so as to provide additional strength to the reinforcement panel. Additionally, a multiplicity of cavities 37 are provided intermediate protuberances 34. Cavities 37 are also generally frustoconical in shape and terminate in base closure walls 37*a* (see also FIG. 5).

Figure 8:
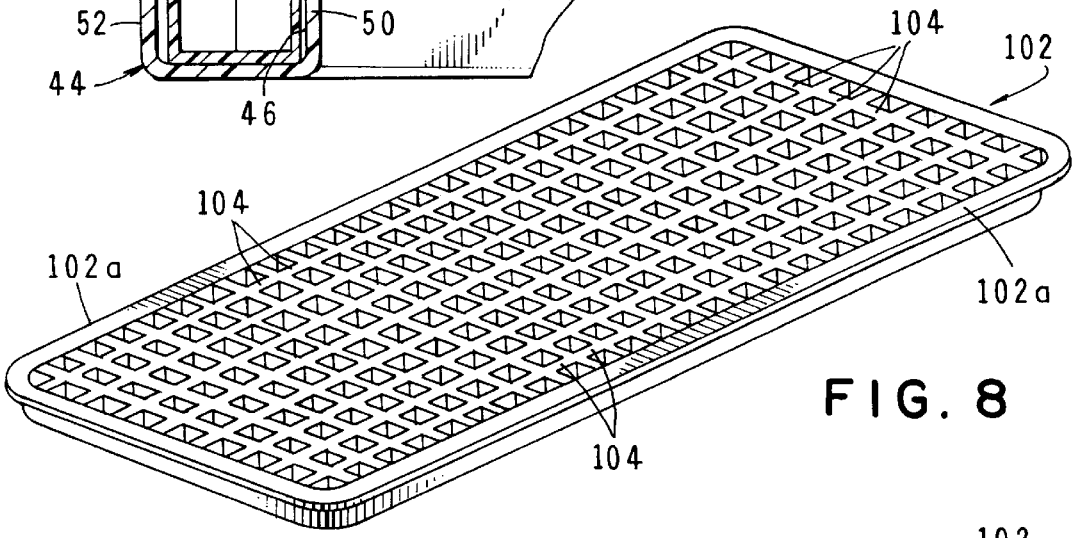
FIG. 8 is a generally perspective view of an alternate form of the structural reinforcement core of the invention.

The peripheral portion of reinforcement panel or core 24 comprises a circumscribing flange-like portion 40 which defines generally planar upper and lower surfaces 40*a* and 40*b*. As best seen in FIGS. 3 and 8, flange-like portion 40 overlays and is connected to a mating flange-like portion 42 formed on a bottom enclosure panel 44 which also forms a part of support platform assembly of the invention. As shown in FIGS. 3 and 4, a channel 46 is formed in the peripheral portion of the enclosure panel and is defined by inner and outer spaced apart circumscribing walls 50 and 52 which also form a part of the peripheral portion of the enclosure panel. As best seen in FIG. 4, a generally planar central wall 54 spans inner wall 50 and is preferably integrally formed therewith. Central wall 54 is provided with a plurality of indentations 54*a* (FIG. 2B), the purpose of which will presently be described.

Receivable within channel 46 of enclosure panel 44 is a novel, strategically shaped reinforcement frame 57 (FIGS. 3, 4, and 6). Reinforcement frame 57 includes a pair of spaced apart, longitudinally extending structural beams or extrusions 57*a* and a pair of spaced apart transversely extending beams or extrusions 57*b*. As illustrated in FIGS. 2A and 5, beams 57*a* and 57*b* are interconnected by four uniquely configured corner assemblies 60. As best seen in FIG. 11, each corner assembly 60 includes a central arcuate shaped, hollow portion 60*a* which is closed by end walls 60*b*. As indicated in FIGS. 5 and 11, end walls 60*b* abut the longitudinally and transversely extending support beams 57*a* and 57*b* when frame 57 is positioned within channel 46 of enclosure panel 44. Beams or extrusions 57*a* and 57*b* (are generally "C") shaped in cross section (FIG. 11) and are preferably formed of a rigid, high strength, plastic or metal material as are the corner assemblies 60. As shown in FIGS. 3 and 4, beams 57*a* and 57*b* each have an upper and lower segment 59*a* and 59*b* respectively and a vertical segment 59*c*. Segment 59*a* includes a generally planar upper surface 59*d*. Reinforcement frame 57 can simply rest within channel 46 or, if desired, can be secured within the channel by any suitable means such as by adhesive bonding.

As illustrated in FIGS. 2B, 3, 4 and 6, a novel edge reinforcing frame 64 is also receivable between peripheral flange 22*c* of cover 22 and wall 52 of enclosure panel 44 in the manner shown in the drawings. As best seen in FIG. 2B, frame 64 includes a pair of longitudinally extending tubular members 64*a* and a pair of transversely extending tubular members 64*b*. Members 64*a* and 64*b* are interconnected by novel corner members 66. As best seen in FIG. 12, each corner member 66 includes an arcuate central portion 66*a* having outwardly extending, fingerlike projection 67 which are closely receivable within tubular members 64*a* and 64*b* when the members are assembled in the manner shown in FIG. 2B. Reinforcing frame 64 can be constructed of a variety of moldable plastic materials such as polyvinyl chloride, polyethlyene, and butyrate and functions to effectively support and attractively trim out the edge portions of the platform assembly in the manner best seen in FIGS. 3 and 4.

Another important feature of the apparatus of this latest form of the invention comprises anchor means for use in securely interconnecting leg assemblies 14 and 15 to the support platform. These anchor means are here provided in the form of a plurality of anchor plates 70 to which the folding legs of the table can be securely interconnected. Anchor plates 70 are positioned within the previously identified, spaced-apart anchor plate receiving indentations 54*a* which are formed in the central portion of closure panel 44. More particularly, a pair of anchor plates 70*a* are received within centrally disposed indentations 54*a* while the remaining anchor plates are received within indentations 54*a* located proximate the side portions of the enclosure panel 44.

To pivotally support leg assemblies 14 and 15 relative to the support platform, novel leg support means are provided. These leg support means here comprise four bearing plates or clamps 74 each of which includes. a concave portion 74*a* that is disposed between spaced-apart wing-like elements 74*b*. The two pairs of cradle assemblies are connected to enclosure panel 44 and to the side anchor plates 70 in the manner shown in FIGS. 3 and 4 by suitable connectors such as self-drilling and tapping threaded fasteners 76 which extend through wing-like portions through the central wall of enclosure panel 44 and into anchor plates 70 in the manner shown in the drawings. With this construction, the convex channels or central portions 74*a* of bearing plates 74 function as bearing means for rotatably supporting the extremities 78*a* of each of the horizontally extending, generally tubular shaped, axle-like members 78 which comprise a part of the leg assemblies 15 and 16 of the invention (FIGS. 2B and 4).

Also forming a part of each of the leg assemblies 15 and 16 is a yoke-like member 80, the arms 80*a* of which are pivotally connected to the downwardly extending legs of each of the leg assemblies. Pivotally connected to each yoke 80 is a connector rod 82 which functions to pivotally interconnect yoke 80 with a plate-like member 84 which is, in turn, affixed by self-drilling and tapping threaded fasteners 86 to the central wall of enclosure panel 44 and to anchor plates 70*a* (FIGS. 2B, and 3). With this construction, the leg assemblies can pivot relative to support platform 22 in the manner illustrated in the drawings. Various types of both fixed and pivoting leg assemblies can be connected to platform 22 and various types of mechanisms can be used to interconnect the leg assemblies with the platform.

In assembling the leg assemblies to the support platform, the four bearing plates 74 are placed over the ends of the tubular members or axles 78 of the leg assemblies. This done, the bearing plates are then connected to the enclosure panel and to the side anchor plates using the previously identified threaded fasteners 76. Similarly, with the yoke assemblies connected to the legs in the manner shown in FIG. 3, plates 84 are connected to the enclosure panel and to the central anchor plates using the previously identified connectors 86.

To complete the assembly of this first form of foldable table, a generally U-shaped, plastic trim strip 89 is slipped over the lower edge of flange 22*c* of cover 22 in the manner shown in FIGS. 3 and 4.

Figure 7:
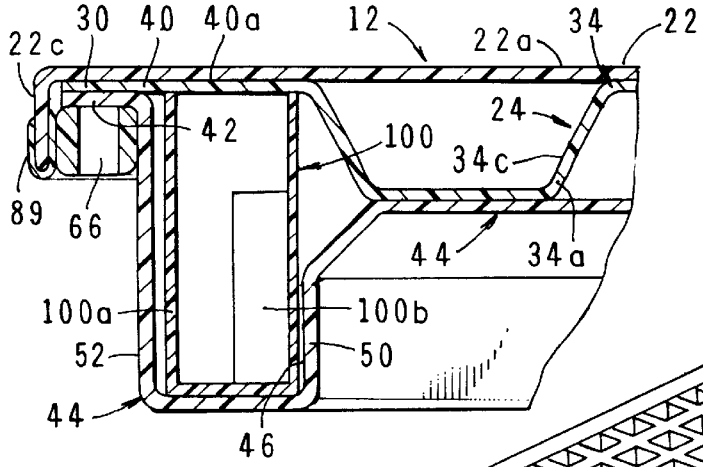
FIG. 7 is a cross-sectional view taken along lines 7—7 of FIG. 5.

Turning to FIG. 7, still another form of the lightweight, high strength folding table of the present invention is there shown. The folding table of this latest form of the invention is virtually identical to the embodiment shown in FIGS. 1 through 6, but includes a different reinforcement frame 100 having reinforcement beams 100*a* and 100*b* which are generally box-shaped in cross section. This latest embodiment comprises a support platform assembly 12 and first and second leg assemblies of the character earlier described.

More particularly, support platform 12 comprises a support member or cover 22 which defines a work surface 22*a* and includes a peripheral side wall 22*c* which circumscribes surface 22*a* and defines a downwardly depending, skirt-like portion of the character shown in FIG. 7. The enclosure panel 44 and the reinforcement core 24 are identical to those previously described and frame 100 is disposed within channel 46 of the enclosure panel in the same manner as previously discussed.

Figure 9:
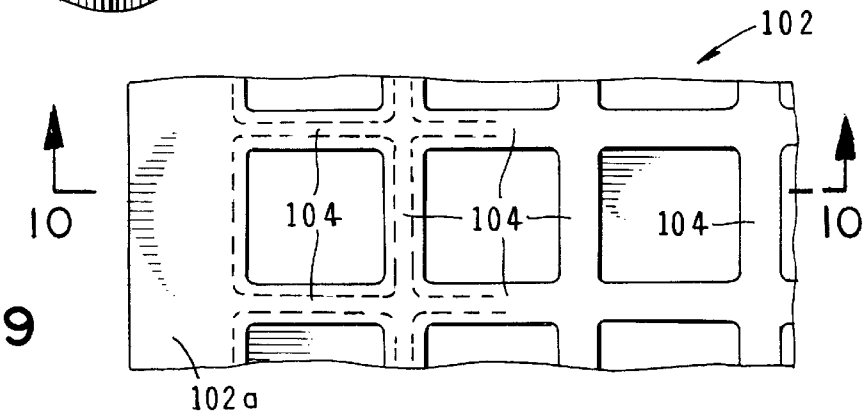
FIG. 9 is an enlarged fragmentary plan view of a portion of the reinforcement core further illustrating the construction of this alternate embodiment of the core of the invention.
Figure 10:
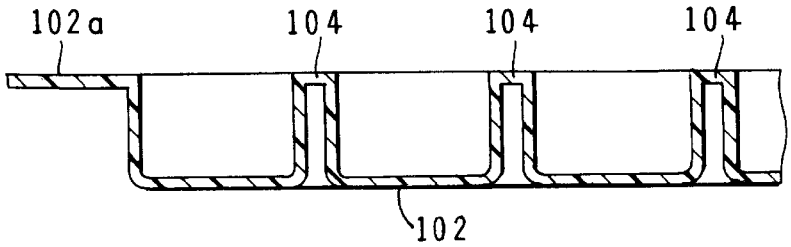
FIG. 10 is a cross-sectional view taken along lines 10—10 of FIG. 9.

Turning next to FIGS. 8 through 10 still another form of the invention is there illustrated. This form of the invention is identical to that previously described, but includes a uniquely configured structural reinforcement core 102 of the character illustrated in FIGS. 8, 9 and 10. As there shown, reinforcement core 102 comprises a panel which is preferably vacuum formed or injection molded into the configuration show in FIG. 8, As indicated in FIGS. 8, 9 and 10, core 102 comprises a multiplicity of generally perpendicularly extending ribs 104 which are generally U-shaped in configuration. These ribs function in the same manner as the frustoconically shaped protuberances 34 previously described.

More particularly, when core 102 is assembled with a support member 22 and an enclosure panel 44 of the character previously described so that panel 102 is disposed between the enclosure panel and the lower surface of the support member ribs 104 will provide substantial structural support to support member 22. Additionally, core 102 is provided with a peripheral flange 102*a*, which is adapted to reside between the reinforcement frame, which may be of the C-shaped configuration shown in FIGS. 1 through 6 or of the box-shaped configuration shown in FIG. 7, so as to impart further structural strength and rigidity to the support platform of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A lightweight, high-strength support platform for use in constructing plastic furniture, comprising:

(a) a support member including a generally planar first surface having a peripheral portion including a downwardly depending flange and a spaced-apart second surface;

(b) a structural reinforcement core connected to said support member, said core having a central portion and a peripheral portion circumscribing said central portion, said central portion being provided with a multiplicity of structural reinforcement members comprising a multiplicity of spaced-apart, generally perpendicularly extending walls, each of which includes an upper extremity disposed proximate said second surface of said support member and a lower extremity;

(c) an enclosure panel connected to said core, said enclosure panel having a central portion and a channel shaped portion circumscribing said central portion, said lower extremities of said multiplicity of walls of said reinforcement core being disposed proximate said central portion of said enclosure panel; and (d) a reinforcement frame received within said channel shaped portion.

2. A support platform as defined in claim 1 in which said multiplicity of walls of said reinforcement core cooperate to provide a multiplicity of open spaces extending between said second surface of said support member and said central portion of said enclosure panel.

3. A support platform as defined in claim 1 in which said support platform further includes an edge reinforcing frame disposed between said downwardly depending peripheral flange and said channel shaped portion of said enclosure panel.

4. A support platform as defined in claim 1 in which said multiplicity of walls of said reinforcement core are connected together.

5. A lightweight, high-strength support platform for use in constructing plastic furniture comprising:

(a) a support member including a generally planar first surface having a peripheral portion including a downwardly depending and spaced apart peripheral flange;

(b) a structural reinforcement core connected to said support member, said core having a central portion and a peripheral portion circumscribing said central portion, said central portion being provided with a multiplicity of structural reinforcement members comprising a multiplicity of spaced-apart, generally perpendicularly extending walls which cooperate to define a multiplicity of open spaces extending downwardly from second surface of said support member;

(c) an enclosure panel connected to said core, said enclosure panel having a central portion and a channel shaped portion circumscribing said central portion;

(d) a reinforcement frame received within said channel shaped portion; and (e) an edge reinforcing frame disposed between said downwardly depending peripheral flange and said channel shaped portion of said enclosure panel.

6. A support platform as defined in claim 5 in which said multiplicity of generally perpendicularly extending walls of said structural reinforcement core extend substantially the entire distance between said second surface of said support member and said enclosure panel.

* * * * *